United States Patent [19]

Samhammer et al.

[11] 4,031,723

[45] June 28, 1977

[54] LOCKABLE ZIPPER CLOSURE

[75] Inventors: Clair A. Samhammer, Dana Point; James Patrick Sullivan, Tustin, both of Calif.

[73] Assignee: Samsonite Corporation, Denver, Colo.

[22] Filed: Mar. 31, 1976

[21] Appl. No.: 672,517

[52] U.S. Cl. ..... 70/68; 190/41 Z; 70/185

[51] Int. Cl.[2] ..... E05B 67/38

[58] Field of Search ..... 70/68, 182, 183, 184, 70/185, 186; 24/205 R, 205.11 R; 190/41 Z

[56] References Cited

UNITED STATES PATENTS

| | | | |
|---|---|---|---|
| 1,705,149 | 3/1929 | Brady | 190/41 Z |
| 1,898,215 | 2/1933 | Schade | 70/68 |
| 1,950,415 | 3/1934 | Rifkin | 70/68 |
| 3,759,073 | 9/1973 | Rifkin | 70/68 |

FOREIGN PATENTS OR APPLICATIONS

| | | | |
|---|---|---|---|
| 698,325 | 11/1964 | Canada | 24/205.11 R |
| 1,036,410 | 7/1966 | United Kingdom | 70/68 |

*Primary Examiner*—Robert L. Wolfe
*Attorney, Agent, or Firm*—George J. Netter; Patrick F. Bright

[57] ABSTRACT

A lockable zipper closure includes at least one slider with a pulling tab that has an opening therein, and means such as a T-shaped column for locking the zipper in the closed position, that is movable from a position in which the column may pass through the opening to a position in which the column will not pass through the opening, and means for locking the column in the position where the column cannot pass through the opening.

13 Claims, 11 Drawing Figures

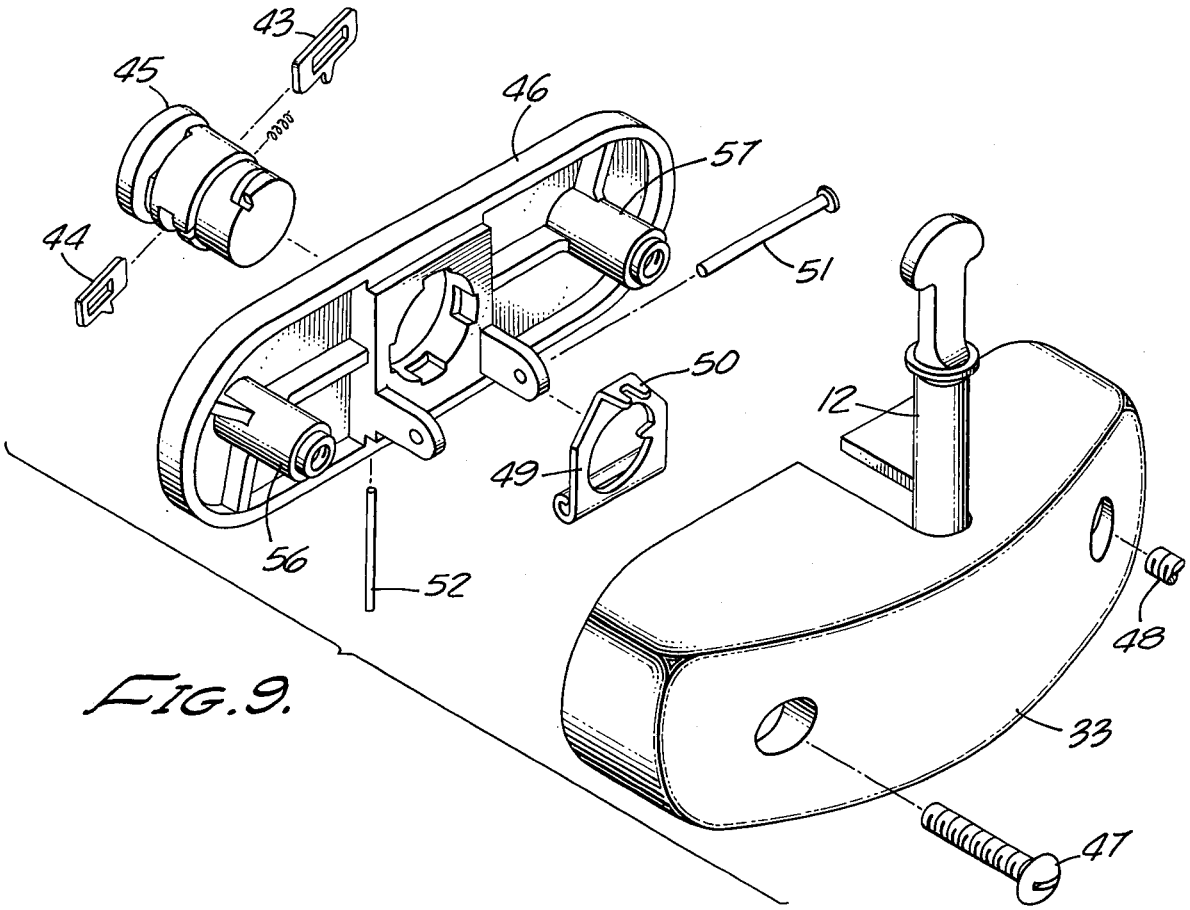
FIG. 9.
FIG. 10.
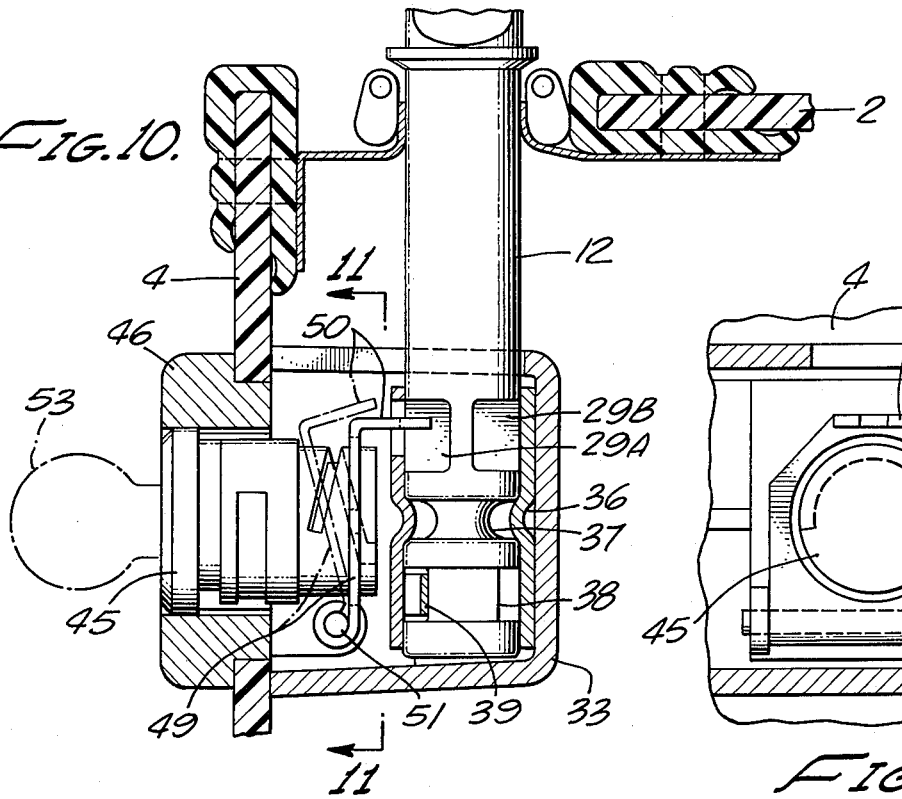
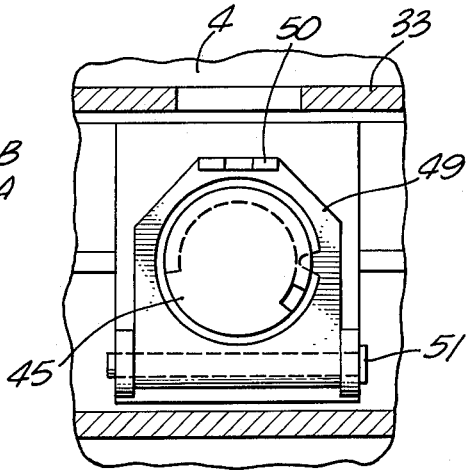
FIG. 11.

LOCKABLE ZIPPER CLOSURE

This invention relates to a lockable zipper closure, particularly a lockable zipper closure for bags such as luggage bags.

U.S. Pat. Nos. 1,705,149; 1,934,360; 1,980,714; 2,002,638; 2,032,019; 2,114,683; 2,157,084; 2,398,947; 2,754,870; 3,292,748; and 3,319,714 all disclose lockable zipper closures. However, none discloses the unique, simple, reliable zipper closure of this invention.

Conventional slide fasteners or zipper closures include a pair of tapes situated in side-by-side relationship, carrying scoops which are moved into and out of interlocking engagement by movement of the slider over the scoops. The slider usually carries a slider pulling means to facilitate slider movement. The pulling means is usually freely movable with respect to the slider itself, permitting exertion of a pulling force on the slider in both the locking and unlocking directions of slider movement. This construction makes it difficult to secure the slider against unauthorized operation. This problem is particularly acute with zipper closures that include a pair of sliders because both sliders must be secured against unauthorized operation, and few satisfactory solutions to this problem have been found.

An object of this invention is to provide a zipper closure that is simple in construction but capable of effectively securing the closure in a closed position.

Another object is to provide a lockable zipper closure for use with bags such as luggage bags where the zipper closure carries two sliders that must both be secured against unauthorized operation where the zipper is in the closed position.

This invention provides a lockable zipper closure which comprises at least one slider which carries slider pulling means having an opening therein, and means for securing the zipper closure in a closed or at least partially closed position. This securing means comprises a column means which, in one position, is adapted to pass through the opening in the slider pulling means. The column means is movable, preferably rotatable, to a locking position in which the column means cannot pass completely through the opening in the slider pulling means. The means for securing the column means in closed or at least partially closed position also includes means for locking the column means in its locking position.

The new lockable zipper closure is particularly advantageous where the zipper carries two sliders that are movable in opposed relation to one another. For such closures, the sliders each include a pulling means having an opening therein, and the column means is preferably positioned to pass through the openings in both of the pulling means at a point where the openings overlap one another.

The new lockable zipper closure means has many uses, and is especially useful for securing the opposing edges of a bag such as a luggage bag. On such bags, the two tapes of the zipper are attached to opposing edges of the opening in the bag, and are provided with one or more sliders. In the embodiments of this invention shown in the drawings, the zipper carries two sliders. In such embodiments, the column means is preferably positioned between the two sliders, and is mounted within the bag on one of its walls so that the column means terminates above the plane of the sliders on the tape of the zipper. In these embodiments, movement of the sliders toward one another closes the zipper portion each slider passes over. The column means is positioned between the sliders to permit each slider pulling means to pass over the end of the column near the point where both zipper portions are closed. The column may be rotated to, and locked in a position in which the column means, or at least a portion of the column means, cannot pass through the openings in the two slider pulling means.

Broadly, the column means comprises a portion that is longer than at least one dimension of the opening in the slider pulling means. Preferably, that portion is bar-shaped, more preferably T-shaped, and the opening in the slider pulling means is preferably slot-shaped. The slot-shaped opening in the slider pulling means is preferably of greater length but is shorter in width than the length of the bar-shaped or T-shaped portion of the column means.

In at least one position, the column means cooperates with locking means to prevent the column means from passing through the opening in the slider pulling means. In a preferred embodiment, the column means includes at least one male means, more preferably integral male means, and the locking means comprises at least one lockable female means engageable with at least one of these male means to prevent movement of the column means from its locked position. The female means may be locked by any one of several known, rugged, simple locks, such as combination locks and key locks.

The invention is illustrated and exemplified in the accompanying drawings which are part of this specification, and in which:

FIG. 9 is a perspective view of another assembly that includes a portion of the lockable zipper closure of this invention;

FIG. 10 is a side elevational view of the assembly shown in FIG. 9, and is similar to the views shown in FIGS. 4 and 7; and FIG. 11 is an elevational view of a portion of the structure shown in FIG. 10, taken along line 11—11 of FIG. 10 in the direction of the arrows.

Figure 1:
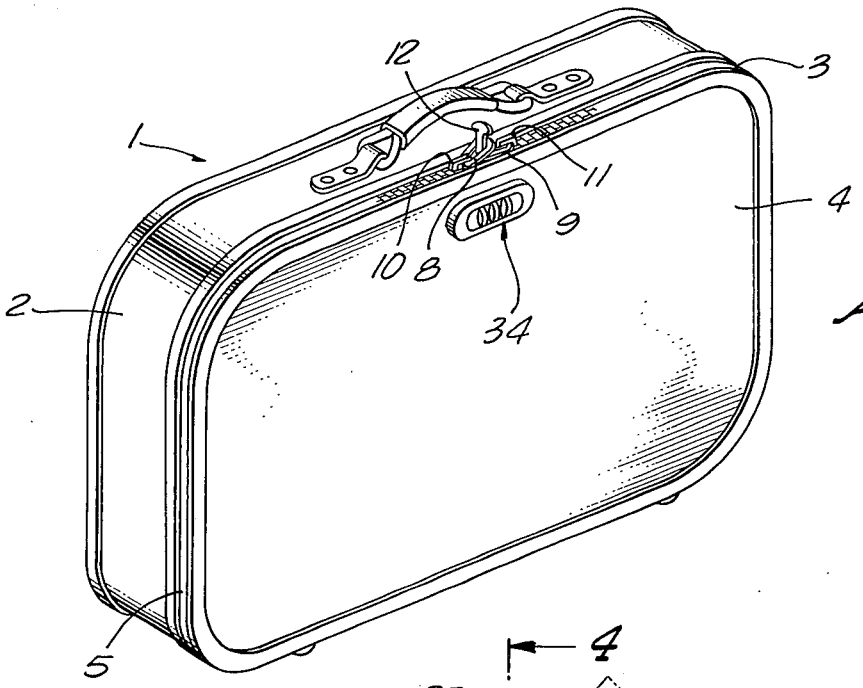
FIG. 1 is a perspective view of a luggage bag provided with the lockable zipper closure of the invention.

FIG. 1 shows a luggage bag 1 which includes a bottom or container member 2, and attached thereto a cover member 4 that is movable to and from the closed position shown in FIG. 1. Along opposing closure edges 3 and 5 of bag 1 are a pair of tapes carrying scoops that may be moved into or out of interlocking engagement by means of sliders 10 and 11. These sliders carry pulling means 8 and 9, respectively, each having an opening therein that can pass over column means 12 when the column is in a position suitable for this purpose.

Figure 8:
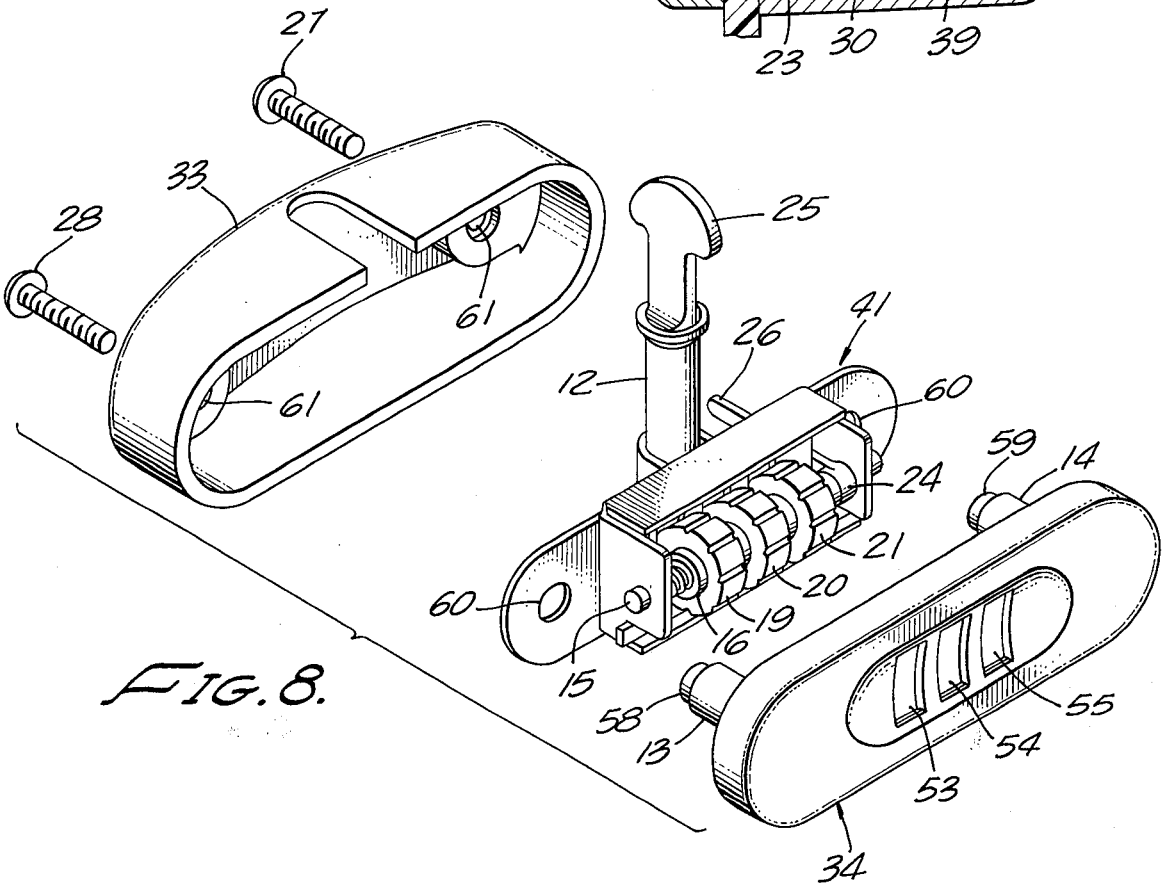
FIG. 8 is a perspective view of an assembly including a portion of the lockable zipper closure of the invention, together with means for mounting the assembly on a bag.

FIG. 8 shows a perspective view of combination lock assembly 41 which includes a portion of the zipper closure of this invention, together with means for mounting this assembly on the wall of a bag such as a luggage bag. Assembly 41 may be attached through the side wall of a bag as seen in FIG. 1 near the zipper closure that is mounted on opposing edges of the opening in the bag. Plate 34 is mounted on the outside wall of bag cover 4 with posts 13 and 14, which are an integral part of plate 34, passing through this outside wall. Combination lock assembly 41 is mounted on the inside wall of bag cover 4, with knobs 19, 20, and 21 projecting through windows 53, 54, and 55, respectively, of plate 34. In one embodiment, posts 13 and 14 may terminate in relatively short, cylindrical sections 58 and 59 that fit through holes 60 in assembly 41. Holes 60 are sufficiently small to prevent assembly 41 from sliding onto posts 13 and 14. Assembly 41 is held within housing 33 and in alignment with plate 334 by screws 27 and 28 which pass through holes 61 in housing 33 and screw into internally threaded posts 13 and 14. Column means 12 projects upwardly from assembly 41, and is retained in that assembly by engagement of grooves 37 and 38 in column means 12 with longitudinal protrusions 36A and 36B, and 39 within assembly 41.

Figure 2:
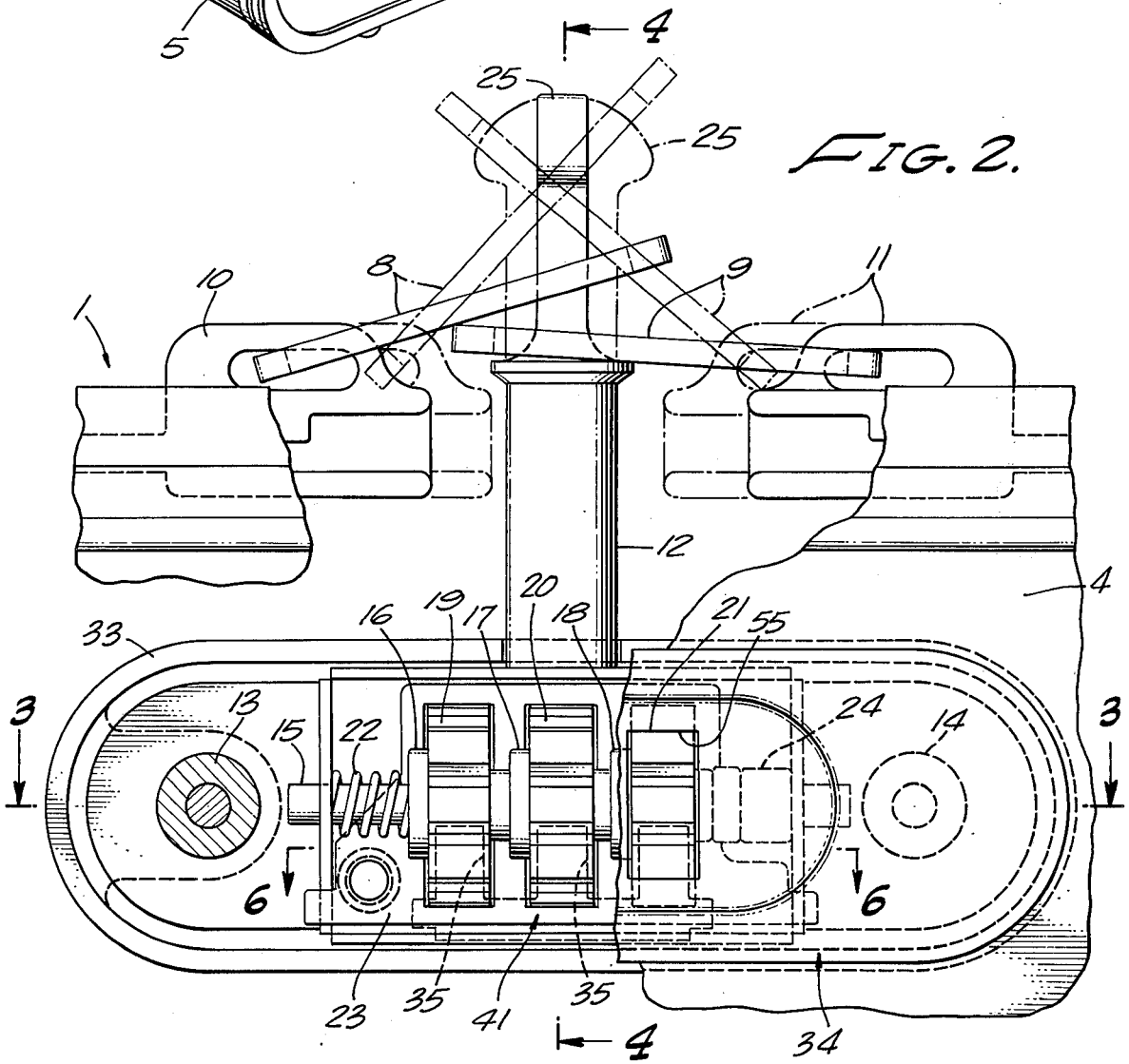
FIG. 2 is an exploded fragmentary side view of the portion of the luggage bag of FIG. 1 that is provided with the lockable zipper closure of the invention and with a combination lock.

FIG. 2 shows an enlarged side view of assembly 41 and column means 12 in conjunction with a zipper carrying two sliders 10 and 11. The combination lock includes knobs 19, 20 and 21 that are operatively attached to cams 16, 17 and 18, respectively. Each of cams 16, 17, and 18 is generally circular in shape, but each includes a flat surface 42 best seen in FIGS. 4 and 7. Where each of faces 42 rests against the surface of plate 23, the female means 40 that is integral with plate 23 does not engage male means 29A or 29B of column means 12, thus permitting column means 12 to be freely rotated on its longitudinal axis. Where one or more of cams 16, 17, and 18 is rotated by operation of knobs 19, 20, or 21, to a position in which any portion of the round surface of a cam engages the surface of plate 23, plate 23 and female means 40 is urged forward to a position in which the female means 40 may engage male means 29A or 29B on column means 12. Male means 29A and 29B may be formed between a pair of relatively deep grooves cut in the column means, but may also be fashioned in any other desirable way.

As seen in FIG. 2, the zipper closure means of the invention comprises a pair of sliders 10 and 11 carrying slider pulling means 8 and 9, respectively. In FIG. 2, the tape portion each slider traverses is closed, and column 12 is rotated to a position in which the openings in slider pulling means 8 and 9 may both pass over the bar-shaped portion 25 of column means 12. After the sliders have passed over column portion 25, column means 12 is rotated to a position in which the slider pulling means cannot pass over column portion 25, and the locking means is actuated to lock column 12 in this position.

Figure 3:
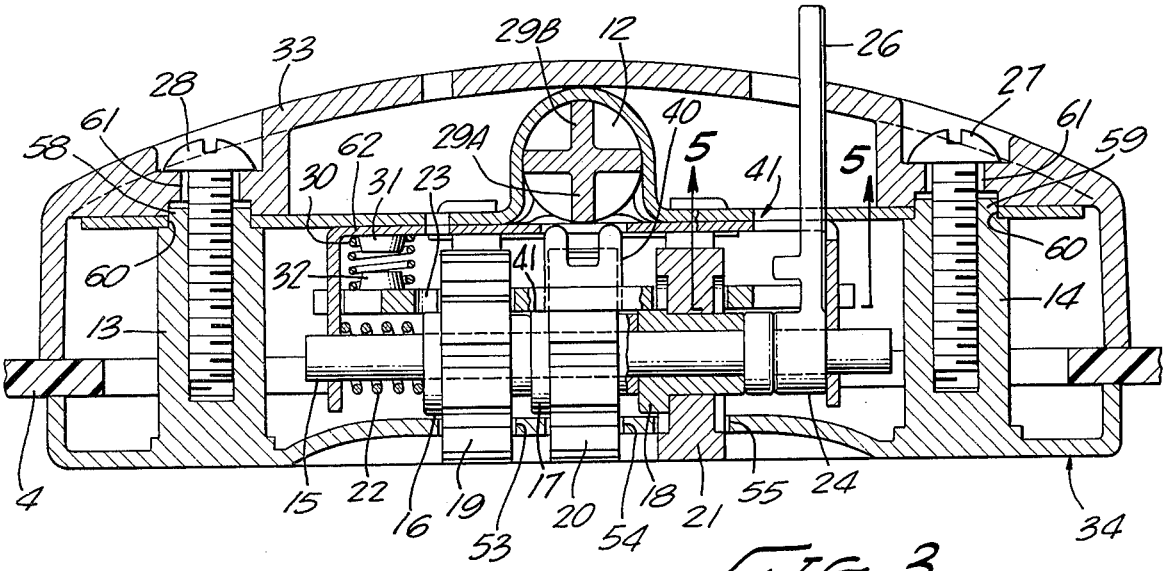
FIG. 3 is a sectional view of a portion of the structure shown in FIG. 2, taken along line 3—3 of FIG. 2 in the direction of the arrows and showing further details of the closure of the invention.
Figure 4:
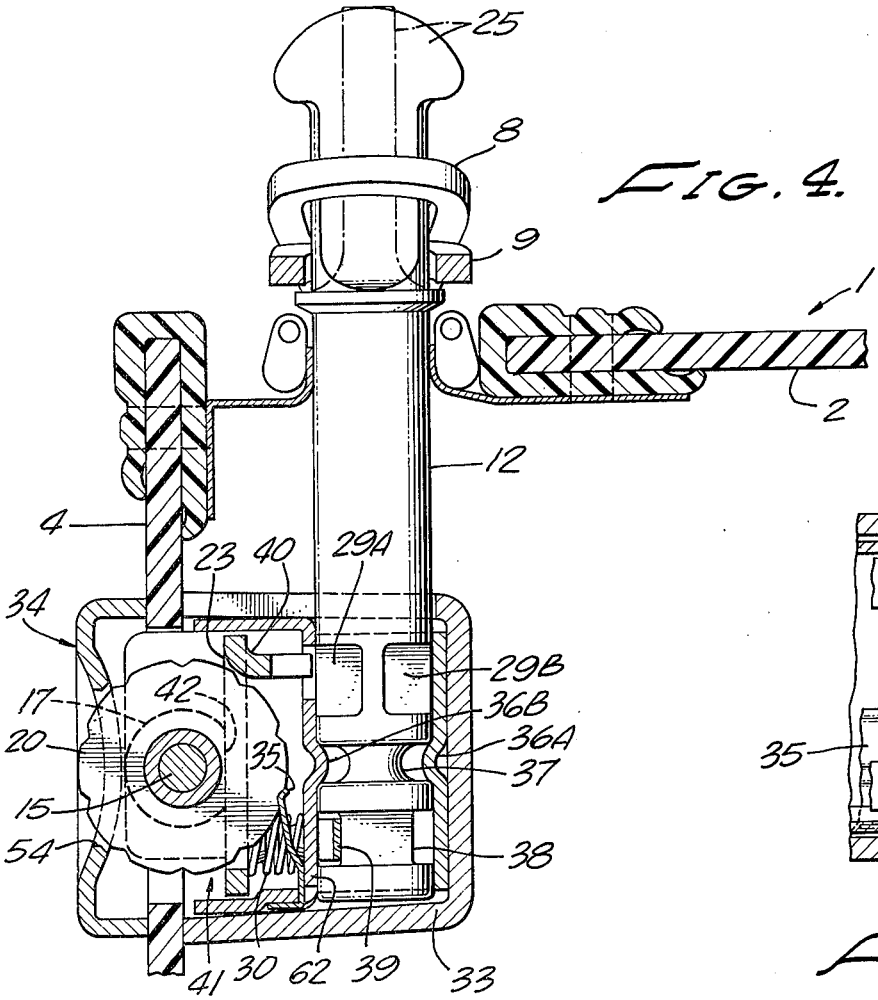
FIG. 4 is a sectional view taken along line 4—4 of FIG. 2 in the direction of the arrows and showing other detail of the closure of the invention.
Figure 5:
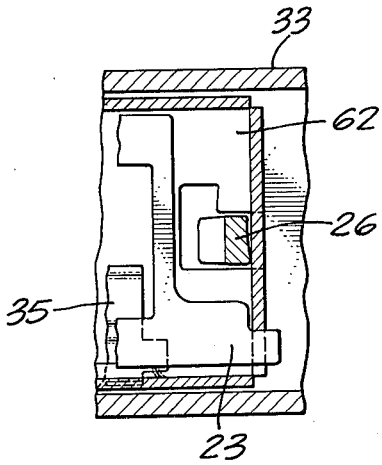
FIG. 5 is a sectional view of a portion of the structure shown in FIG. 3, taken along line 5—5 of FIG. 3 in the direction of the arrows.
Figure 6:
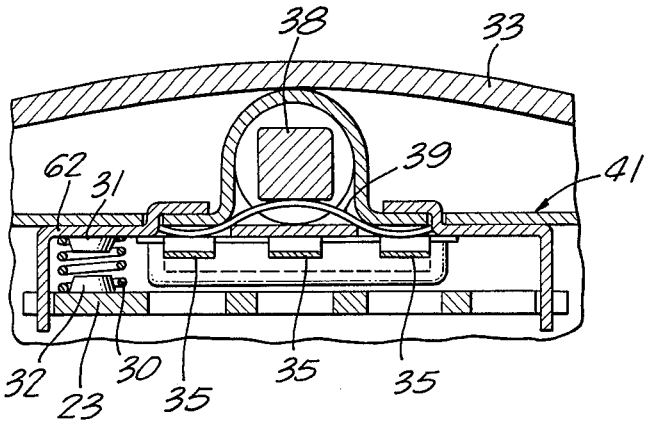
FIG. 6 is a sectional view of the structure shown in FIG. 2, taken along line 6—6 of FIG. 2 in the direction of the arrows.

As best seen in FIGS. 3 and 4, column means 12 and male means 29A and 29B of column means 12 have been rotated to a position in which the openings in the slider pulling means cannot pass over column portion 25, and female means 40 may be moved into locking engagement with male means 29A or 29B.

Figure 7:
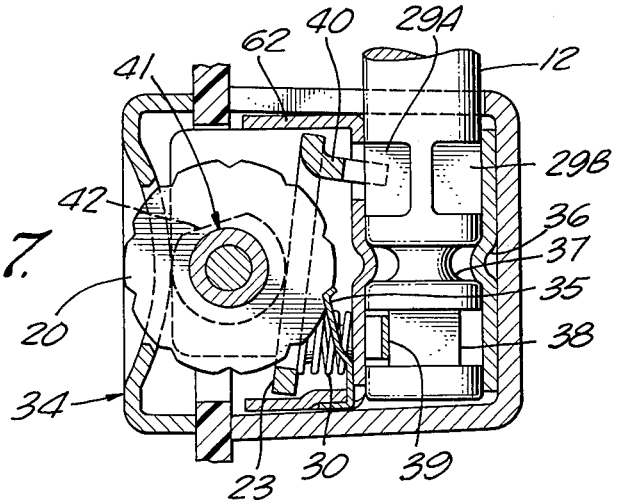
FIG. 7 shows a view similar to FIG. 4, with the column means shown in the locked position.

FIG. 7 shows female means 40 in locked engagement with male means 29A, precluding rotation of column 12 and preventing unauthorized access to the bag.

The cam actuated combination lock may readily be changed from one combination to another. Knobs 19, 20, and 21 have numerals or other indicia on their edges which are visible through the openings in plate 34. Only one combination of numerals on these three knobs will position the flat surfaces of cams 16, 17, and 18 against plate 23, thus permitting disengagement of female means 40 and plate 23 from male means 29A and 29B on column 12. The combination may be changed by moving shaft 15 laterally against the force exerted by spring 22. Handle 26 and integral washer 24 facilitate this movement. Cams 16, 17, and 18 are fixedly attached to shaft 15 and move with it; knobs 19, 20, and 21 are not so attached, but are linked only to the cams. Lateral movement of shaft 15 and cams 16, 17, and 18 frees knobs 19, 20, and 21 for movement to a different position, thus allowing selection of a different combination.

Other features of lock assembly 41 include spring 30, which is mounted between knob 32 on plate 23 and knob 30 on plate 62, and tends to prevent movement of plate 23 and female means 40 into locking engagement with male means 29A or 29B. Pawl 35 engages the knurls on knobs 19, 20, and 21 to prevent free rotation of these knobs.

FIGS. 9, 10, and 11 show an alternate locking means for use with the zipper closure of this invention. As seen in FIG. 9, this assembly includes plate 46, which is affixed to the outer wall of a bag such as a luggage bag. Columns 56 and 57, which are an integral part of plate 46, pass through the wall of the bag, and are attached thereto by means of housing 33 mounted on the inner wall of the bag. Screws 47 and 48 pass through the holes in housing 33 and are screwed into internally threaded columns 56 and 57. Column 12 is held within cover 33 by the same means shown in FIG. 4 and 7, as FIG. 10 illustrates. Plate 49, which is rotatably held in plate 46 by pin 51, and its integral female means 50 are moved into and out of engagement with male means 29A and 29B of column 12 through the rotation of key-actuatable tumbler 45, which is held in assembly 46 by means of plates 43, and 44, and pin 52. As best seen in FIG. 10, rotation of tumbler 45 moves plate 49 and integral female means 50 into and out of engagement with male means 29A and 29B, just as plate 23 and female mens 40 do in the embodiment of the invention shown in FIGS. 4 and 7.

Wht is claimed is:

1. A lockable zipper closure which comprises at least one slider with slider pulling means having an opening therein, and means for securing said zipper closure in at least partially closed position, said securing means comprising column means comprising a portion that is longer than at least one dimension of the opening in said slider pulling means adapted to pass through said opening in said pulling means, said column means being movable to a locking position in which said column means cannot pass completely through said opening, and means for locking said column means in said locking position.

2. The lockable zipper closure of claim 1 comprising two sliders, each having a slider pulling means with an opening therein, wherein said two sliders are movable in opposed relation to one another to permit the openings in each of said pulling means to overlap one another, and wherein said column means is positioned to pass through both openings in said slider pulling means where they overlap.

3. The lockable zipper closure of claim 1 wherein said lockable zipper closure is attached to the opposing edges of a bag.

4. The lockable zipper closure of claims 1 wherein the bag is a luggage bag.

5. The lockable zipper closure of claims 1 wherein the column means portion is bar-shaped, and said opening is slot-shaped, and of greater length but smaller width than the length of the bar-shaped portion.

6. The lockable zipper closure of claim 1 wherein the locking means comprises at least one male means on said column means, and at least one female means engageable with at least one of said male means to prevent rotational movement of said column means.

7. The lockable zipper closure of claim 6 wherein the female means is movable from its locked to its unlocked position by means of a spring-loaded, cam-actuatable lock.

8. The lockable zipper closure of claim 7 wherein the spring-loaded, cam-actuatable lock is a combination lock.

9. The lockable zipper closure of claim 6 wherein said male means is an integral portion of said column means.

10. The lockable zipper closure of claim 9 wherein the male means comprises an integral portion of said column means formed between relatively deep grooves in said column means.

11. The lockable zipper closure of claim 10 comprising two of said male means.

12. The lockable zipper closure of claim 2 wherein the column means portion is bar-shaped, and said opening is slotshaped, and of greater length but smaller width than the length of the bar-shaped portion.

13. The lockable zipper closure of claim 2 wherein the locking means comprises at least one male means on said column means, and at least one female means engageable with at least one of said male means to prevent rotational movement of said column means.

* * * * *

UNITED STATES PATENT AND TRADEMARK OFFICE

CERTIFICATE OF CORRECTION

PATENT NO. : 4,031,723

DATED : June 28, 1977

INVENTOR(S) : Clair A. Samhammer and James Patrick Sullivan

It is certified that error appears in the above-identified patent and that said Letters Patent are hereby corrected as shown below:

Column 3, line 29, "334" should read --34--.

Column 4, line 57, "female mens 40" should read --female means 40--.

Column 4, line 59, "Wht" should read --What--.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*